252-104 AU 157 EX
7/24/84 XR 4,461,652

United States Patent [19]
Richmond

[11] Patent Number: 4,461,652
[45] Date of Patent: Jul. 24, 1984

[54] BARNACLE REMOVAL PROCESS AND PRODUCT

[76] Inventor: Therezia L. Richmond, Box 116, Buffalo, N.Y. 14222

[21] Appl. No.: 417,216

[22] Filed: Sep. 13, 1982

[51] Int. Cl.[3] ..... C23G 5/02; B08B 3/04; C11D 3/48; C11D 3/395

[52] U.S. Cl. ..... 134/2; 134/42; 252/95; 252/102; 252/104; 252/106

[58] Field of Search ..... 134/2, 42; 114/222; 252/95, 96, 98, 102, 104, 106; 206/15.05, 18

[56] References Cited

U.S. PATENT DOCUMENTS

| | | | |
|---|---|---|---|
| 3,702,256 | 11/1972 | Stevens | 106/18 |
| 3,915,880 | 10/1975 | Sepulveda | 252/102 |
| 4,115,130 | 9/1978 | Crump et al. | 106/18 |
| 4,154,818 | 5/1979 | Canada et al. | 106/15.05 |
| 4,164,477 | 8/1979 | Whitley | 252/106 |
| 4,181,622 | 1/1980 | Gavin | 134/42 |
| 4,323,466 | 4/1982 | Curry et al. | 252/106 |

OTHER PUBLICATIONS

Rohm and Haas, "Sanitary Chemicals-Hyamine 3500", Sep. 1977, pp. 1 and 5.

*Primary Examiner*—S. Leon Bashore, Jr.
*Assistant Examiner*—K. M. Hastings
*Attorney, Agent, or Firm*—James J. Ralabate

[57] ABSTRACT

Barnacles from marine vessels are removed by spraying the surfaces thereof with a mixture the active ingredients of which are a hydrocarbon liquid oil; a surfactant; alcohol; a metal hypochlorite; and an alkyl, dialkyl benzyl ammonium salt. After the solution has been applied to the surfaces for about 20 minutes, the barnacles are removed by power spraying the surfaces with water.

5 Claims, No Drawings

BARNACLE REMOVAL PROCESS AND PRODUCT

BACKGROUND OF THE INVENTION

The present invention relates to the removal of barnacles primarily from the hulls of marine vessels and, more particularly, to an effective composition and process for applying each composition in the barnacle removal process.

Typically, barnacle encrustations are removed from the underwater surfaces of marine vessels by manually scraping the dry-docked vessel. This process is tedious, expensive and extremely time consuming.

SUMMARY OF THE INVENTION

The foregoing problems, as well as others not specifically mentioned, are effectively and efficiently overcome according to the teachings of the present invention, which provides a barnacle removing solution and method of applying the same whereby barnacles are easily removed or released from the surfaces to which they have become adhered.

The solution of the invention includes a mixture of a hydrocarbon liquid oil, a surfactant or detergent, alcohol and a metal hypochlorite soluble in the oil. Also preferably included is an alkyl, dialkyl benzyl ammonium salt soluble in the oil.

This mixture is preferably sprayed on the barnacle encrusted surfaces and, after a period of time sufficient to enable the active ingredients of the solution to soften the barnacles, the same may be easily removed by power spraying the surfaces with water.

Other characterizing features and advantages of the present invention will become readily apparent from the detailed description thereof to follow.

DETAILED DESCRIPTION OF THE PREFERRED EMBODIMENT

It has been found, according to the invention, that barnacle crustations can be easily removed from the surfaces of marine vessels and the like by preparing a liquid mixture or solution of various commercially available ingredients. More specifically, a pine oil solution (consisting of pine oil, 79.16 weight percent; soap, 9.20 weight percent; isopropyl alcohol, 1.64 weight percent; and inert ingredients, 10 weight percent) mixed with a solution of sodium hypochlorite, 5.25 weight percent; and inert ingredients, 94.75 weight percent (sold under the Trademark, CLOROX) has been found to be extremely effective. A sanitizing solution of n-Alkyl dimethyl benzyl ammonium chlorides, 1.29 weight percent; and n-Alkyl dimethyl ethylbenzyl ammonium chlorides, 1.29 weight percent; and inert ingredients, 97.42 weight percent (such as "J-80" manufactured by Johnson & Johnson) may also be included as a preservative and as a cleanser for the surface in the barnacle removal process.

The above three commercially available ingredients are mixed in substantially equal proportions to form a stock solution (having a long shelf-life) and then may be diluted with substantially 50% water just prior to use. The solution is sprayed on the barnacle encrusted surfaces. After about 20 minutes the barnacles become sufficiently soft such that they may be easily removed by sprays of high pressure water.

With the above mixture of ingredients, a 55 Ft. yacht, heavily encrusted with barnacles, has been cleaned in approximately 2.5 hours. This is to be contrasted with the conventional, manual scraping process which typically requires three to four persons working about 24 hours.

Barnacles were also removed, using the mixture of the present invention, from a 55 Ft. wooden commercial fishing vessel that had been in the ocean (uncleaned) for approximately four years. The time for cleaning this vessel was about 4 hours.

It should be quite obvious to one skilled in this art that:

1. Any other hydrocarbon liquid oil with a boiling point between substantially 100 degrees C. to 200 degrees C. may be substituted for the pine oil;
2. Any surfactant (non-ionic or anionic) or any anionic detergent may be substituted for the soap;
3. Any alcohol having a boiling point between substantially 60 degrees C. and 200 degrees C. may be substituted for the isopropyl alcohol;
4. Any metal hypochlorite, soluble in the oil, may be substituted for the sodium hypochlorite; and
5. Any suitable surfactant may be used such as alkyl dialkyl benzyl ammonium salts. Also any Alkyl, dialkyl benzyl ammonium salt, soluble in the oil (the number of methylene groups in the respective chains may be the same or different), may be substituted for the n-alkyl dimethyl benzyl ammonium chloride and the n-alkyl dimethyl ethyl-benzyl ammonium chloride.

The preferred formulation for the stock mixture may be combined in substantially the following weight proportions:

1. Hydrocarbon liquid oil—15 to 35%;
2. Surfactant—1.5 to 6% including the alkyl, dialkyl benzyl ammonium salts listed in 5. below;
3. Alcohol—0 to 2%;
4. Metal hypochlorite—0.5 to 5%;
5. Alkyl, diakyl benzyl ammonium salt—0.5 to 1.5%;
6. Water—30 to 50%; and
7. Inert carries—52.5 to 0.5%.

The inert carrier may include any inert diluent or solvent such as a petroleum solvent, water or soluble salt.

Prior to use, the stock solution (active and inert ingredients) may be diluted substantially 1:1 with water.

Although a preferred embodiment of the present invention has been disclosed and described, changes will obviously occur to those skilled in the art without departing from the spirit thereof. It is, therefore, intended that the present invention is to be limited only by the scope of the appended claims and the obvious equivalencies thereof.

What is claimed is:

1. A process for removing barnacles from the surfaces of marine vessels and the like, including the steps of:

spraying on said surfaces a composition comprising a hydrocarbon oil from about 15 to about 35 weight percent;

a surfactant from about 1.5 to 6 weight percent;

an alcohol from about 0 to 2 weight percent;

a metal hypochlorite soluble in said oil from about 0.5 to 5 weight percent said surfactant comprising from about 0.5 to 1.5 weight percent of an alkyl, dialkyl benzyl ammonium salt;

inert ingredients from about 82.5 to 50.5 weight percent; and spraying water on said surfaces after a predetermined period of time sufficient to remove the softened barnacles.

2. The process according to claim 1, wherein:

said predetermined period of time is substantially 20 minutes.

3. The process according to claim 1, wherein:

said composition is diluted with water prior to spraying the same on said surfaces.

4. The process according to claim 1, wherein:

said hydrocarbon oil comprises pine oil;

said metal hypochlorite comprises sodium hypochlorite; and said alkyl, dialkyl benzyl ammonium salt comprises a compound selected from the group consisting of n-alkyl dimethyl benzyl ammonium chloride, n-alkyl dimethyl lower alkyl benzyl ammonium chloride and mixtures thereof.

5. The process according to claim 4, wherein:

said hydrocarbon oil is about 26 weight percent;

said surfactant is about 3 weight percent;

said alcohol is about 0.55 weight percent;

said metal hypochlorite is about 1.75 weight percent;

said alkyl, dialkyl benzyl ammonium salt is about 0.85 weight percent; and said inert ingredients are about 67.85 weight percent.

* * * * *